US008835372B2

(12) United States Patent
Jennewein

(10) Patent No.: US 8,835,372 B2
(45) Date of Patent: Sep. 16, 2014

(54) WATER-SOLUBLE POUCH

(75) Inventor: Marc Jennewein, Taunusstein (DE)

(73) Assignee: The Procter & Gamble Company, Cincinnati, OH (US)

( * ) Notice: Subject to any disclaimer, the term of this patent is extended or adjusted under 35 U.S.C. 154(b) by 73 days.

(21) Appl. No.: 12/785,540

(22) Filed: May 24, 2010

(65) Prior Publication Data

US 2010/0305020 A1 Dec. 2, 2010

(30) Foreign Application Priority Data

Jun. 2, 2009 (EP) ..... 09161692

(51) Int. Cl.

| | |
|---|---|
| ***C11D 17/04*** | (2006.01) |
| ***C11D 3/37*** | (2006.01) |
| ***C11D 3/42*** | (2006.01) |
| ***C11D 3/00*** | (2006.01) |
| ***C11D 3/12*** | (2006.01) |

(52) U.S. Cl.

CPC ..... *C11D 17/043* (2013.01); *C11D 17/045* (2013.01); *C11D 3/3765* (2013.01); *C11D 3/0084* (2013.01); *C11D 3/1213* (2013.01); *C11D 3/0089* (2013.01)

USPC ..... 510/296; 510/394; 510/406; 510/439; 510/475

(58) Field of Classification Search

USPC ..... 510/296, 406, 439, 394, 475

See application file for complete search history.

(56) References Cited

U.S. PATENT DOCUMENTS

| | | | | |
|---|---|---|---|---|
| 2,220,099 | A | 11/1940 | Fritz et al. | |
| 2,477,383 | A | 7/1949 | Lewis | |
| 3,664,961 | A | 5/1972 | Norris | |
| 3,835,163 | A | 9/1974 | Rapko | |
| 3,919,678 | A | 11/1975 | Penfold | |
| 3,923,679 | A | 12/1975 | Rapko | |
| 4,102,903 | A | 7/1978 | Crutchfield | |
| 4,120,874 | A | 10/1978 | Culberson | |
| 4,158,635 | A | 6/1979 | Crutchfiled | |
| 4,222,905 | A | 9/1980 | Crockrell | |
| 4,239,659 | A | 12/1980 | Murphy | |
| 4,246,612 | A | 1/1981 | Berry et al. | |
| 4,810,410 | A | 3/1989 | Diakun et al. | |
| 5,114,611 | A | 5/1992 | Van Kralingen et al. | |
| 5,227,084 | A | 7/1993 | Martens et al. | |
| 5,487,947 | A * | 1/1996 | Kakishita et al. | 428/424.4 |
| 6,727,215 | B2 * | 4/2004 | Roberts et al. | 510/296 |
| 7,125,828 | B2 * | 10/2006 | Catlin et al. | 510/220 |
| 7,208,459 | B2 * | 4/2007 | Sadlowski et al. | 510/419 |
| 7,238,655 | B2 * | 7/2007 | Ness | 512/4 |
| 7,790,664 | B2 * | 9/2010 | Harrington et al. | 510/220 |
| 8,153,574 | B2 * | 4/2012 | Boutique et al. | 510/342 |
| 8,293,697 | B2 * | 10/2012 | Boutique et al. | 510/342 |
| 2003/0050346 | A1 * | 3/2003 | Hsu | 516/20 |
| 2003/0060378 | A1 * | 3/2003 | Hsu et al. | 510/130 |
| 2005/0065059 | A1 * | 3/2005 | Roselle et al. | 510/475 |
| 2005/0143278 | A1 * | 6/2005 | Pegelow et al. | 510/439 |
| 2005/0166333 | A1 * | 8/2005 | Kaaret et al. | 8/115.51 |
| 2006/0069005 | A1 * | 3/2006 | Song | 510/220 |
| 2007/0128144 | A1 * | 6/2007 | Bonastre Gilabert et al. | 424/70.13 |
| 2008/0177090 | A1 * | 7/2008 | Valenti et al. | 549/68 |
| 2008/0234169 | A1 * | 9/2008 | Boutique et al. | 510/343 |
| 2010/0210501 | A1 * | 8/2010 | Caggioni et al. | 510/338 |
| 2010/0234263 | A1 * | 9/2010 | Wasan et al. | 510/218 |
| 2010/0240569 | A1 * | 9/2010 | Boutique et al. | 510/299 |

FOREIGN PATENT DOCUMENTS

| | | | |
|---|---|---|---|
| EP | 0170386 | A2 | 2/1986 |
| EP | 0170386 | A3 | 7/1986 |
| EP | 0332294 | A | 8/1992 |
| EP | 0170386 | B1 | 12/1993 |
| EP | 0482807 | A | 12/1995 |
| EP | 2088187 | | 8/2009 |
| WO | WO 02/12432 | A | 2/2002 |
| WO | WO 2007/111888 | A | 10/2007 |
| WO | WO 2007/111888 | A1 * | 10/2007 |
| WO | WO 2007/111898 | A | 10/2007 |

* cited by examiner

*Primary Examiner* — Lorna M Douyon

(74) *Attorney, Agent, or Firm* — Gregory S. Darley-Emerson; Steven W. Miller

(57) ABSTRACT

The present application relates to a water soluble pouch comprising at least one compartment, wherein said compartment comprises a first liquid composition comprising an opacifier and an antioxidant and has a fresh Hunter L value of greater than 7 and a b value of less than 4.

16 Claims, 1 Drawing Sheet

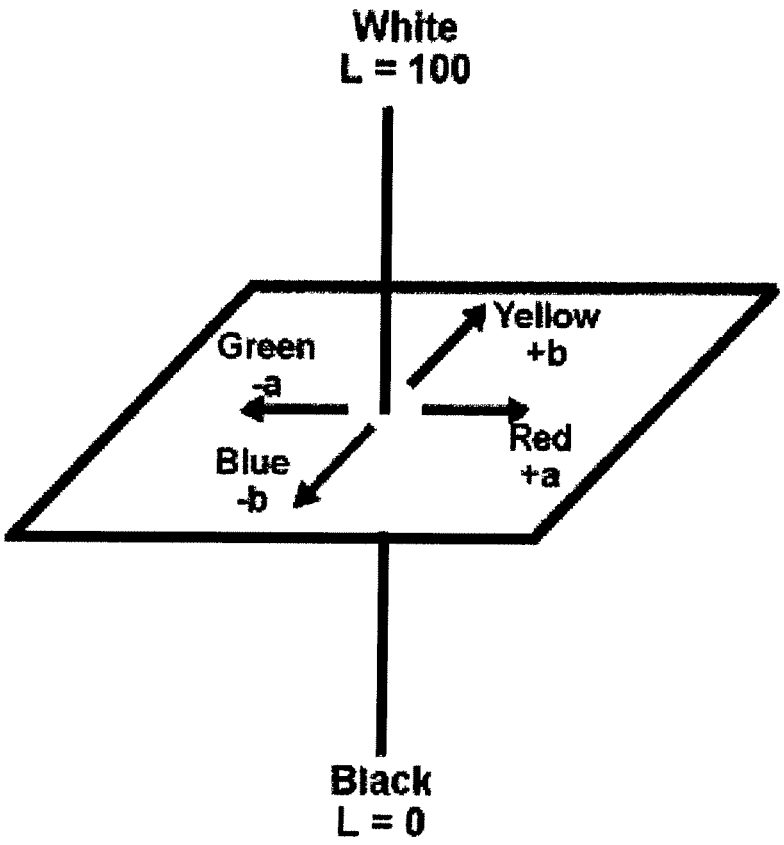
White
L = 100
Yellow
+b
Green
-a
Red
+a
Blue
-b
Black
L = 0

WATER-SOLUBLE POUCH

TECHNICAL FIELD

The present invention relates to a water-soluble pouch, more preferably a multi-compartment pouch, comprising at least a first composition. The pouches being suitable for use in laundry cleaning.

BACKGROUND TO THE INVENTION

Water-soluble pouches have recently become popular. This product provides the consumer with a unitary dose of detergent, conveniently packaged in a pouch, thereby reducing the necessary contact with the hand of the user. Such water-soluble pouches are made using a typically transparent or translucent film, allowing the user to see the product within the pouch. This affords the manufacturer the opportunity to design the aesthetics of the product to the consumer's preferences, demonstrating differences and benefits. Multi-compartment pouches bring further advantages. For example, the manufacturer is able to formulate, otherwise, incompatible ingredients into a single product or create a sequential release product to meet cleaning, softening or ingredient compatibility demands.

The Applicant has learnt that consumers connote opaque, preferably white, compositions with improved cleaning and care. Hence the Applicant has made efforts to design a water-soluble pouch product wherein at least a first compartment comprises an opaque, and substantially white, liquid composition.

Moreover, when designing a multi-compartment pouch, the Applicant has learnt that a consumer, in their acceptance of water-soluble pouch products, need to understand the individual benefit each compartment brings. It is therefore particularly desirable to formulate the compositions within the compartments such that they appear visibly different. Hence the detergent manufacturer may add different colouring agents to each composition. However different colours in such close proximity over shadow one another, clash or are simply not seen because of an over riding effect of another. It is preferred, therefore, that one compartment comprises a composition that is generally white or black, to create a background on which another colour can be presented.

A white product can be achieved by the addition of an opacifier to the composition. However the Applicants have found that whilst opacifier produces a white product at the point of manufacture, the product rapidly degrades. The degraded product takes on a yellow hue and continues to become more yellow on ageing.

One solution to this problem is to increase the level of opacifier. Yellowing of the product is not prevented, but the level of opacifier could provide sufficient whiteness for the average shelf life of the product. The Applicants have found however that, at the level of opacifier necessary to achieve this effect, the opacifier has a negative impact on water-soluble film dissolution, residue formation and spotting on fabrics being washed.

In addressing this problem, the Applicant has found that by combining opacifier with antioxidant, the yellowing effect of the opacifier, can be controlled. This solution not only prevents or reduces the discolouration, but also means that the manufacturer does not need to employ excessive amounts of opacifier.

SUMMARY OF THE INVENTION

According to the present invention there is provided a water soluble pouch comprising at least one compartment, wherein said compartment comprises a first liquid composition comprising an opacifier and an antioxidant and has a fresh Hunter L value of greater than 70 and a b value of less than 4.

BRIEF DESCRIPTION OF THE DRAWING

FIG. 1 is a graphical representation of an Lab color system.

DETAILED DESCRIPTION OF THE INVENTION

The detergent product of the present invention is a water-soluble pouch, more preferably a multi-compartment water-soluble pouch. The pouch comprises a water-soluble film and at least a first, and optionally a second compartment. The first compartment comprises a first composition, comprising an opacifier and an antioxidant. The second compartment comprises a second compartment. Preferably the pouch comprises a third compartment and a third composition. The optionally second and third compositions are preferably visibly distinct from each other and the first composition.

A difference in aesthetic appearance can be achieved in a number of ways, however the first compartment of the present pouch comprises an opaque liquid composition. The compartments of the pouch may be the same size or volume. Alternatively, the compartments of the pouch may have different sizes, with different internal volumes. The compartments may also be different from one another in terms of texture. Hence one compartment may be glossy, whilst the other is matt. This can be readily achieved as one side of a water-soluble film is often glossy, whilst the other has a matt finish. Alternatively the film used to make a compartment may be treated in a way so as to emboss, engrave or print the film. Embossing may be achieved by adhering material to the film using any suitable means described in the art. Engraving may be achieved by applying pressure onto the film using any suitable technique available in the art. Printing may be achieved using any suitable printer and process available in the art. Alternatively, the film itself may be coloured, allowing the manufacturer to select different coloured films for each compartment. Alternatively the films may be transparent or translucent and the composition contained within may be coloured. Thus in a preferred embodiment of the present invention the first compartment contains an opaque product, coloured any colour selected from the group consisting of white, green, blue, orange, red, yellow, pink or purple, preferably white. The second and subsequent compartment preferably has a different colour and is coloured a colour selected from the group consisting of yellow, orange, pink, purple, blue or green, more preferably green or blue. In one embodiment the multi-compartment pouch comprises a first compartment which is opaque and white and second and third compartments which are coloured toning colours of green or blue.

The compartments of the present multi-compartment pouches can be separate, but are preferably conjoined in any suitable manner. Most preferably the second and optionally third or subsequent compartments are superimposed on the first compartment. In one embodiment, the third compartment may be superimposed on the second compartment, which is in turn superimposed on the first compartment in a sandwich configuration. Alternatively the second and third compartments are superimposed on the first compartment. However it is also equally envisaged that the first, second and optionally third and subsequent compartments may be attached to one another in a side by side relationship. The compartments may be packed in a string, each compartment being individually separable by a perforation line. Hence each compartment may be individually torn-off from the remainder of the string by the end-user, for example, so as to pre-treat or post-treat a fabric with a composition from a compartment.

In a preferred embodiment the present pouch comprises three compartments consisting of a large first compartment and two smaller compartments. The second and third smaller compartments are superimposed on the first larger compartment. The size and geometry of the compartments are chosen such that this arrangement is achievable.

The geometry of the compartments may be the same or different. In a preferred embodiment the second and optionally third compartment have a different geometry and shape to the first compartment. In this embodiment the second and optionally third compartments are arranged in a design on the first compartment. Said design may be decorative, educative, illustrative for example to illustrate a concept or instruction, or used to indicate origin of the product. In a preferred embodiment the first compartment is the largest compartment having two large faces sealed around the perimeter. The second compartment is smaller covering less than 75%, more preferably less than 50% of the surface area of one face of the first compartment. In the embodiment wherein there is a third compartment, the above structure is the same but the second and third compartments cover less than 60%, more preferably less than 50%, even more preferably less than 45% of the surface area of one face of the first compartment.

The pouch is preferably made of a film material which is soluble or dispersible in water, and has a water-solubility of at least 50%, preferably at least 75% or even at least 95%, as measured by the method set out here after using a glass-filter with a maximum pore size of 20 microns:

50 grams±0.1 gram of pouch material is added in a preweighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred pouch materials are polymeric materials, preferably polymers which are formed into a film or sheet. The pouch material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Naturally, different film material and/or films of different thickness may be employed in making the compartments of the present invention. A benefit in selecting different films is that the resulting compartments may exhibit different solubility or release characteristics.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

For reasons of deformability pouches or pouch compartments containing a component which is liquid will preferably contain an air bubble having a volume of up to about 50%, preferably up to about 40%, more preferably up to about 30%, more preferably up to about 20%, more preferably up to about 10% of the volume space of said compartment.

Process for Making the Water-Soluble Pouch

The process of the present invention may be made using any suitable equipment and method. Single compartment pouches are made using vertical, but preferably horizontal form filling techniques commonly known in the art. The film is preferably dampened, more preferably heated to increase the malleability thereof. Even more preferably, the method also involves the use of a vacuum to draw the film into a suitable mould. The vacuum drawing the film into the mould can be applied for 0.2 to 5 seconds, preferably 0.3 to 3 or even more preferably 0.5 to 1.5 seconds, once the film is on the horizontal portion of the surface. This vacuum may preferably be such that it provides an under-pressure of between −100 mbar to −1000 mbar, or even from −200 mbar to −600 mbar.

The moulds, in which the pouches are made, can have any shape, length, width and depth, depending on the required dimensions of the pouches. The moulds can also vary in size and shape from one to another, if desirable. For example, it may be preferred that the volume of the final pouches is between 5 and 300 ml, or even 10 and 150 ml or even 20 and 100 ml and that the mould sizes are adjusted accordingly.

Heat can be applied to the film, in the process commonly known as thermoforming, by any means. For example the film may be heated directly by passing it under a heating element or through hot air, prior to feeding it onto the surface or once on the surface. Alternatively it may be heated indirectly, for example by heating the surface or applying a hot item onto the film. Most preferably the film is heated using an infra red light. The film is preferably heated to a temperature of 50 to 120° C., or even 60 to 90° C. Alternatively, the film can be wetted by any mean, for example directly by spraying a wetting agent (including water, solutions of the film material or plasticizers for the film material) onto the film, prior to feeding it onto the surface or once on the surface, or indirectly by wetting the surface or by applying a wet item onto the film.

Once a film has been heated/wetted, it is drawn into an appropriate mould, preferably using a vacuum. The filling of the moulded film can be done by any known method for filling (preferably moving) items. The most preferred method will depend on the product form and speed of filling required. Preferably the moulded film is filled by in-line filling techniques. The filled, open pouches are then closed, using a second film, by any suitable method. Preferably, this is also done while in horizontal position and in continuous, constant motion. Preferably the closing is done by continuously feeding a second film, preferably water-soluble film, over and onto the open pouches and then preferably sealing the first and second film together, typically in the area between the moulds and thus between the pouches.

Preferred methods of sealing include heat sealing, solvent welding, and solvent or wet sealing. It is preferred that only the area which is to form the seal, is treated with heat or solvent. The heat or solvent can be applied by any method, preferably on the closing material, preferably only on the areas which are to form the seal. If solvent or wet sealing or welding is used, it may be preferred that heat is also applied. Preferred wet or solvent sealing/welding methods include applying selectively solvent onto the area between the moulds, or on the closing material, by for example, spraying or printing this onto these areas, and then applying pressure onto these areas, to form the seal. Sealing rolls and belts as described above (optionally also providing heat) can be used, for example.

The formed pouches can then be cut by a cutting device. Cutting can be done using any known method. It may be preferred that the cutting is also done in continuous manner, and preferably with constant speed and preferably while in horizontal position. The cutting device can, for example, be a sharp item or a hot item, whereby in the latter case, the hot item 'burns' through the film/sealing area.

The different compartments of a multi-compartment pouch may be made together in a side-by-side style and consecutive pouches are not cut. Alternatively, the compartments can be made separately. According to this process and preferred arrangement, the pouches are made according to the process comprising the steps of:

a) forming an first compartment (as described above);
b) forming a recess within some or all of the closed compartment formed in step (a), to generate a second moulded compartment superposed above the first compartment;
c) filling and closing the second compartments by means of a third film;
d) sealing said first, second and third films; and
e) cutting the films to produce a multi-compartment pouch.

Said recess formed in step b is preferably achieved by applying a vacuum to the compartment prepared in step a).

Alternatively the second, and optionally third, compartment(s) can be made in a separate step and then combined with the first compartment as described in our co-pending application EP 08101442.5 which is incorporated herein by reference. A particularly preferred process comprises the steps of:

a) forming a first compartment, optionally using heat and/or vacuum, using a first film on a first forming machine;
b) filling said first compartment with a first composition;
c) on a second forming machine, deforming a second film, optionally using heat and vacuum, to make a second and optionally third moulded compartment;
d) filling the second and optionally third compartments;
e) sealing the second and optionally third compartment using a third film;
f) placing the sealed second and optionally third compartments onto the first compartment;
g) sealing the first, second and optionally third compartments; and
h) cutting the films to produce a multi-compartment pouch The first and second forming machines are selected based on their suitability to perform the above process. The first forming machine is preferably a horizontal forming machine. The second forming machine is preferably a rotary drum forming machine, preferably located above the first forming machine.

It will be understood moreover that by the use of appropriate feed stations, it is possible to manufacture multi-compartment pouches incorporating a number of different or distinctive compositions and/or different or distinctive liquid, gel or paste compositions.

Detergent Composition

The first composition of the present invention is a liquid. By the term 'liquid' it is meant to include liquid, paste, waxy or gel compositions. The liquid composition may comprise a solid. Solids may include powder or agglomerates, such as micro-capsules, beads, noodles or one or more pearlised balls or mixtures thereof. Such a solid element may provide a technical benefit, through the wash or as a pre-treat, delayed or sequential release component. Alternatively it may provide an aesthetic effect.

The first compartment comprises the main wash detergent composition. Said composition comprises an opacifier and antioxidant. Second and third compositions, where present preferably comprise a colouring agent and do not comprise an opacifier. The weight ratio of the first to second or third liquid compositions, where present, is preferably from 1:1 to 20:1, more preferably from 2:1 to 10:1. The weight ratio of the second to third composition, where present, is from 1:5 to 5:1, more preferably 1:2 to 2:1. Most preferably the weight ratio of second to third composition is 1:1

The construction of the multi-compartment pouch according to the present invention provides benefits in terms of aesthetic appeal. A further benefit of said construction is the ability to separate, otherwise incompatible, ingredients. In a preferred aspect of the present invention, the first composition comprises an opacifier. Second and/or third compositions are preferably darker than the first composition.

Other ingredients that could preferably be separated include whitening agents that are sensitive to other constituents of the composition. For example triphenyl methane whitening agents are sensitive to pH, becoming unstable in compositions with pH greater than 9 and Thiazolium whitening agents are not stable in the presence of perfumes. The pH of the composition containing the whitening agent could thus be separated from the main detergent ingredients comprising a higher pH and perfume. Equally cationic species are incompatible with an overtly anionic composition. Hence for example when a composition comprises high levels of anionic surfactants, cationic surfactants, which provide improved cleaning, or polymers such as deposition aids, can be separated into a different compartment. A bleach system or components of a bleaching system may be other ingredients that could be successfully separated from the main detergent composition. Bleach systems are difficult to formulate in liquid environments as the bleach becomes unstable and/or degrades.

Opacifier

The first composition of the present invention comprises an opacifier. An opacifier according to the present invention is a solid, inert compound which does not dissolve in the composition and refracts, scatters or absorbs most light wavelengths. Suitable opacifiers have a refractive index (RI) substantially different from the system in which it is incorporated. The colour of a composition can be accurately and reliably measured using the Hunter L, a, b colour scale. The Hunter scale has been in existence since the 1950s and is a well recognized colour measuring technique known in the art. The Hunter colour space is organized as a cube. The L axis runs from top to bottom; the maximum L being 100 which is white and the minimum value is zero, which is black. The a and b axes have no specific numerical limits, however positive a is red, negative a is green, positive b is yellow and negative b is blue (see FIG. 1). Delta values (ΔL, Δa and Δb) can be measured and are associated with a colour change. The total colour difference, ΔE, can also be calculated. The ΔE is a single value that takes into account the differences between the L, a and b of test and comparison samples. The ΔE is calculated as follows; Using $L_1$, $a_1$, $b_1$ and $L_2$, $a_2$ and $b_2$ $$\Delta E=\sqrt{(L_2-L_1)^2+(a_2-a_1)^2+(b_2-b_1)^2}$$

A just noticeable difference (JND) is characterized as a ΔE of greater than 2.3. The JND is the smallest detectable difference possible with the human eye between a starting and secondary level of a particular sensory stimulus.

The measurements of the present invention are taken on a HunterLab colour measurement instrument (Hunter Lab Color Quest XE), set as follows;

Illuminant: D65

Angle of observer: 10°

Mode: reflection

The instrument is used as per the manufacturers instructions. A sample of 20 mL are tested in an optically clear glass cell having a fixed path length of 10 mm and dimensions 55 mm by 57 mm. The measurement type is reflectance measurement RSIN, which measures the diffuse and specular reflectance of the sample at the port. The measurements are made with the specular exclusion port door closed.

Fresh Hunter colour value is a measure of the colour parameters of a fresh sample, immediately after preparation.

2 day storage Hunter value, is to mean that the colour of the sample is measured after 2 days storage at 50° C.

5 day storage Hunter value, is to mean that the colour of the sample is measured after 5 days storage at 50° C.

10 day storage Hunter value, is to mean that the colour of the sample is measures after 10 days storage at 50° C.

A delta hunter value or ΔE is equally measured fresh, and after 2, 5 and 10 days storage. In these calculations the comparison samples ($L_1$, $a_1$, $b_1$) are the values as measured fresh.

Sufficient opacifier is added to the composition to result in a fresh hunter L value of greater than 70, more preferably greater than 72, more preferably greater than 75. The first composition preferably has a 10 day storage Hunter L value of greater than 70, more preferably greater than 72, most preferably greater than 75. The first composition has a b value of less than 4, more preferably less than 1. Preferably the ΔE at 10 days storage of the first compartment versus fresh is less than 7, more preferably less than 5, more preferably less than 2, most preferably less than 1.

Where the invention relates to a multi-compartment pouch, comprising a first and second composition and optionally a third composition, is it preferred that the contrast in colour between the fresh compositions of the first compartment and the second or third compositions, ΔE fresh compartments, is greater than 35, more preferably greater 40, most preferably greater than 43.

The opacifier is preferably selected from the group consisting of styrene/acrylate latexes, titanium dioxide, Tin dioxide, any forms of modified TiO2, for example carbon modified TiO2 or metallic doped (e.g. Platinum, Rhodium) TiO2 or stannic oxide, bismuth oxychloride or bismuth oxychloride coated TiO2/Mica, silica coated TiO2 or metal oxide coated and mixtures thereof. Particularly preferred styrene/acrylate latexes are those available from the Rohm & Haas Company sold under the trademark Acusol. The latexes are characterized by pH of about 2 to about 3, having approximately 40% solids in water, with particle size of about 0.1 to about 0.5 micron. Specifically preferred Acusol® polymers include Acusol® OP301 (styrene/acrylate) polymer, Acusol® OP302, (Styrene/Acrylate/Divinylbenzene Copolymer), Acusol® OP303 (Styrene/Acrylamide Copolymer), Acusol® OP305 (Styrene/PEG-10 Maleate/Nonoxynol-10 Maleate/Acrylate Copolymer) and (Styrene/Acrylate/PEG-10 Dimaleate Copolymer) and mixtures thereof. Preferred species have molecular weight of from 1000 to 1 000 000, more preferably from 2000 to 500 000, most preferably from 5000 to 20 000.

The opacifier is preferably present in sufficient amount to leave the composition, in which it is incorporated, white. Where the opacifier is an inorganic opacifier (e.g. TiO2, or modifications thereof) the opacifier is preferably present at a level of from 0.001% to 1%, more preferably from 0.01% to 0.5%, most preferably from 0.05% to 0.15% by weight of the composition.

Where the opacifier is an organic opacifier (e.g. styrene/acrylate latexes), the opacifier is preferably present at a level of from 0.001% to 2.5%, more preferably from 1% to 2.2%, most preferably from 1.4% to 1.8% by weight of the composition.

Antioxidant

The first composition of the present invention comprises an antioxidant. The second and third compositions may also comprise antioxidant. Although not wishing to be bound by theory, the Applicants believe that the presence of antioxidant reduced or preferably stops the reaction of reactive compounds in the formula which tend to be oxidized over time and higher temperature and which can lead to yellowing.

An antioxidant according to the present invention, is a molecule capable of slowing or preventing the oxidation of other molecules. Oxidation reactions can produce free radicals, which in turn can start chain reactions of degradation. Antioxidants terminate these chain reactions by removing the free radical intermediates and inhibiting other oxidation reactions by being oxidized themselves. As a result antioxidants are often reducing agents. The antioxidant is preferably selected from the group consisting of butylated hydroxyl toluene (BHT), butylated hydroxyl anisole (BHA), trimethoxy benzoic acid (TMBA), α, β, λ and δ tocophenol (vitamin E acetate), 6 hydroxy-2,5,7,8-tetra-methylchroman-2-carboxylic acid (trolox), 1,2, benzisothiazoline-3-one (proxel GLX), tannic acid, galic acid, Tinoguard AO-6, Tinoguard TS, ascorbic acid, alkylated phenol, ethoxyquine 2,2,4 trimethyl, 1-2-dihydroquinoline, 2,6 di or tert or butyl hydroquinone, tert, butyl, hydroxyl anisole, lignosulphonic acid and salts thereof, benzofuran, benzopyran, tocopherol sorbate, butylated hydroxyl benzoic acid and salts thereof, galic acid and its alkyl esters, uric acid, salts thereof and alkyl esters, sorbic acid and salts thereof, dihydroxy fumaric acid and salts thereof, and mixtures thereof. Preferred antioxidants are those selected from the group consisting of alkali and alkali earth metal sulfites and hydrosulfites, more preferably sodium sulfite or hydrosulfite.

The antioxidant is preferably present at a level of from 0.01% to 2%, more preferably from 0.1% to 1%, most preferably from 0.3% to 0.5%.

Where inorganic opacifier is used, the opacifier and antioxidant are preferably present at a ratio of from 0.1 to 0.5, more preferably from 0.12 to 0.35. Whereas, where an organic opacifier is used, opacifier and antioxidant are preferably present at a ratio of from 2 to 6, more preferably from 3 to 5.

Optional Detergent Composition Components

The compositions of the present invention may comprise one or more of the ingredients as discussed below.

Surfactants or Detersive Surfactants

The compositions of the present invention preferably comprise from about 1% to 80% by weight of a surfactant. Surfactant is particularly preferred as a component of the first composition. Preferably said first composition comprises from about 5% to 50% by weight of surfactant. The second and third compositions may comprise surfactant at levels of from 0.1 to 99.9%.

Detersive surfactants utilized can be of the anionic, nonionic, zwitterionic, ampholytic or cationic type or can comprise compatible mixtures of these types. More preferably surfactants are selected from the group consisting of anionic, nonionic, cationic surfactants and mixtures thereof. Preferably the compositions are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Fabric Care Benefit Agents

The compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the composition, are suitably at levels of up to about 30% by weight of the composition, more typically from about 1% to about 20%, preferably from about 2% to about 10%.

Detersive Enzymes

Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compositions are from about 0.0001% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

Deposition Aid

As used herein, "deposition aid" refers to any cationic polymer or combination of cationic polymers that significantly enhance the deposition of a fabric care benefit agent onto the fabric during laundering.

Preferably, the deposition aid is a cationic or amphoteric polymer. The amphoteric polymers of the present invention will also have a net cationic charge, i.e.; the total cationic charges on these polymers will exceed the total anionic charge. Nonlimiting examples of deposition enhancing agents are cationic polysaccharides, chitosan and its derivatives and cationic synthetic polymers. Preferred cationic polysaccharides include cationic cellulose derivatives, cationic guar gum derivatives, chitosan and derivatives and cationic starches.

Rheology Modifier

In a preferred embodiment of the present invention, the composition comprises a rheology modifier. The rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Polymeric rheology modifiers are preferably selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Builder

The compositions of the present invention may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. Particularly preferred are citrate builders, e.g., citric acid and soluble salts thereof (particularly sodium salt Other preferred builders include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA), aluminosilicates such as zeolite A, B or MAP; fatty acids or salts, preferably sodium salts, thereof, preferably C12-C18 saturated and/or unsaturated fatty acids; and alkali or alkali earth metal carbonates preferably sodium carbonate.

Bleaching System

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt (III) and related complexes (U.S. Pat. No. 4,810,410).

Perfume

Perfumes are preferably incorporated into the detergent compositions of the present invention. The perfumes may be prepared as a premix liquid, may be linked with a carrier material, such as cyclodextrin or may be encapsulated. When encapsulated the perfumes are preferably encapsulated in a melamine/formaldehyde coating. The applicants have found that even in the presence of such perfume microcapsules, the present system is able to maintain the whiteness and prevent or reduce disolouration of the composition. This is further surprising as the aldehyde aspect of perfumes and the formaldehyde coating further heighten the risk of discolouration (yellowing) of the composition.

Whitening Agent

A composition of the present invention may comprise a whitening agent. Such dyes have been found to exhibit good tinting efficiency during a laundry wash cycle without exhibiting excessive undesirable build up during laundering.

The whitening agent is included in the total laundry detergent composition in an amount sufficient to provide a tinting effect to fabric washed in a solution containing the detergent. In one embodiment, a multi-compartment pouch comprises, by weight, from about 0.0001% to about 1%, more preferably from about 0.0001% to about 0.5% by weight of the composition, and even more preferably from about 0.0001% to about 0.3% by weight of the composition.

Examples of preferred commercially available whitening agents according to the present invention are selected from the list consisting of triarylmethane blue basic dye; a triarylmethane violet basic dye; a methine blue basic dye; a methane violet basic dye; an anthraquinone blue basic dye; an antraquinone violet basic dye; an azo dye basic blue 16, basic blue 65, basic blue 66, basic blue 67, basic blue 71, basic blue 159, basic violet 19, basic violet 35, basic violet 38, or basic violet 48; oxazine dye basic blue 3, basic blue 75, basic blue 95, basic blue 122, basic blue 124, basic blue 141, or Nile blue A; a xanthene dye basic violet 10; an alkoxylated anthraquinone polymeric colorant; alkoxylated thiophene; triphenyl methane; antraquinones; or a mixture thereof.

Most Preferably the whitening agent is characterized by the following structure:

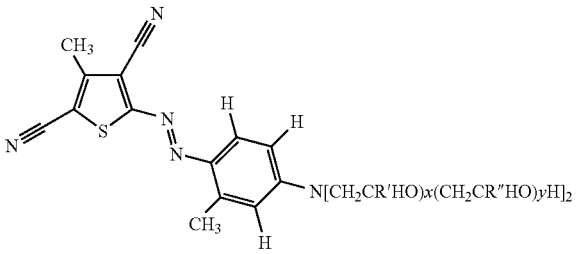

wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_z$ H, and mixtures thereof; wherein $x+y\leq5$; wherein $y\geq1$; and wherein z=0 to 5

Solvent System

The solvent system in the present compositions can be a solvent system containing water alone or mixtures of organic solvents with water. Preferred organic solvents include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used. Solvent systems can be absent, for example from anhydrous solid embodiments of the invention, but more typically are present at levels in the range of from about 0.1% to about 98%, preferably at least about 1% to about 50%, more usually from about 5% to about 25%.

Pearlescent Agent

The compositions of the present invention may comprise a pearlescent agent. Said pearlescent agent may be organic or inorganic, but is preferably inorganic. Most preferably the pearlescent agent is selected from mica, TiO2 coated mica, bismuth oxychloride or mixtures thereof.

Other Adjuncts

Examples of other suitable cleaning adjunct materials include, but are not limited to; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents and mixtures thereof.

Composition Preparation

The compositions herein can generally be prepared by mixing the ingredients together. If a pearlescent material is used it should be added in the late stages of mixing. If a rheology modifier is used, it is preferred to first form a pre-mix within which the rheology modifier is dispersed in a portion of the water and optionally other ingredients eventually used to comprise the compositions. This pre-mix is formed in such a way that it forms a structured liquid. To this structured pre-mix can then be added, while the pre-mix is under agitation, the surfactant(s) and essential laundry adjunct materials, along with water and whatever optional detergent composition adjuncts are to be used.

Secondary Packaging

The multi-compartment pouches of the present invention are preferably further packaged in an outer package. Said outer package may be a see-through or partially see-through container, for example a transparent or translucent bag, tub, carton or bottle. The pack can be made of plastic or any other suitable material, provided the material is strong enough to protect the pouches during transport. This kind of pack is also very useful because the user does not need to open the pack to see how many pouches there are left. Alternatively, the pack can have non-see-through outer packaging, perhaps with indicia or artwork representing the visually-distinctive contents of the pack.

Process of Washing

The pouches of the present invention are suitable for laundry cleaning applications. The pouches are suitable for hand or machine washing conditions. When machine washing, the pouch may be delivered from the dispensing drawer or may be added directly into the washing machine drum.

EXAMPLES

The data below provides evidence of the benefits of the present invention:

| | Colour measurement | | | Difference versus fresh | | | |
|---|---|---|---|---|---|---|---|
| D65/10° | L | a | b | ΔL | Δa | Δb | ΔE |
| 1.6% Acusol, Nil Sulphite | | | | | | | |
| fresh | 73.95 | −0.88 | 4.34 | 0.0 | 0.0 | 0.0 | 0.0 |
| 2 days 50° C. | 71.95 | −0.57 | 7.44 | −2.0 | 0.3 | 3.1 | 3.7 |
| 5 days 50° C. | 71.10 | −0.58 | 10.31 | −2.9 | 0.3 | 6.0 | 6.6 |
| 10 days 50° C. | 69.18 | 0.32 | 11.05 | −4.8 | 1.2 | 6.7 | 8.3 |
| 1.6% Acusol, 0.4% Sulphite | | | | | | | |
| fresh | 76.28 | 0.21 | −3.52 | 0.0 | 0.0 | 0.0 | 0.0 |
| 2 days 50° C. | 76.10 | 0.30 | −3.49 | −0.2 | 0.1 | 0.0 | 0.2 |
| 5 days 50° C. | 76.08 | 0.20 | −3.12 | −0.2 | 0.0 | 0.4 | 0.4 |
| 10 days 50° C. | 76.14 | 0.06 | −3.05 | −0.1 | −0.2 | 0.5 | 0.5 |
| 0.1% TiO2, Nil Sulphite | | | | | | | |
| fresh | 73.22 | −0.21 | 7.78 | 0.0 | 0.0 | 0.0 | 0.0 |
| 2 days 50° C. | 71.56 | 0.36 | 10.90 | −1.7 | 0.6 | 3.1 | 3.6 |
| 5 days 50° C. | 70.19 | 0.70 | 12.88 | −3.0 | 0.9 | 5.1 | 6.0 |
| 10 days 50° C. | 68.83 | 1.43 | 13.49 | −4.4 | 1.6 | 5.7 | 7.4 |
| 0.1% TiO2, 0.4% Sulphite | | | | | | | |
| fresh | 76.18 | 0.76 | −0.01 | 0.0 | 0.0 | 0.0 | 0.0 |
| 2 days 50° C. | 76.04 | 0.86 | 0.10 | −0.1 | 0.1 | 0.1 | 0.2 |
| 5 days 50° C. | 76.12 | 0.69 | 0.23 | −0.1 | −0.1 | 0.2 | 0.3 |
| 10 days 50° C. | 76.07 | 0.78 | 0.30 | −0.1 | 0.0 | 0.3 | 0.3 |

The following are examples of the pouch products of the present invention:

| Base composition<br>Active material in Wt. % | Ex. 1 |
|---|---|
| Glycerol (min 99) | 5.3 |
| 1,2-propanediol | 10.0 |
| Citric Acid | 0.5 |
| Monoethanolamine | 10.0 |
| Caustic soda | — |
| Dequest 2010 | 1.1 |
| Potassium sulfite | 0.2 |
| Nonionic Marlipal C24EO7 | 20.1 |
| HLAS | 24.6 |
| Optical brightener FWA49 | 0.2 |
| C12-15 Fatty acid | 16.4 |
| Polymer Lutensit Z96 | 2.9 |
| Polyethyleneimine ethoxylate PEI600 E20 | 1.1 |
| MgCl2 | 0.2 |
| Enzymes | ppm |

| | Ex 2: | | | Ex 3: | | |
|---|---|---|---|---|---|---|
| Composition | 1 | 2 | 3 | 1 | 2 | 3 |
| Active material in Wt. % | | | | | | |
| Perfume | 40 ml | 5 ml | 5 ml | 40 ml | 5 ml | 5 ml |
| Dyes | 1.6 ppm | 1.6 ppm | 1.6 ppm | 1.6 ppm | 1.6 ppm | 1.6 ppm |
| TiO2 | 0.1 | — | — | — | 0.1 | — |

-continued

| | Ex 2: | | | Ex 3: | | |
|---|---|---|---|---|---|---|
| Composition | 1 | 2 | 3 | 1 | 2 | 3 |
| Sodium Sulfite | 0.4 | 0.4 | 0.4 | 0.3 | 0.3 | 0.3 |
| Acusol 305, Rhom&Haas | 1.2 | | | 2 | — | — |
| Hydrogenated castor oil | 0.14 | 0.14 | 0.14 | 0.14 | 0.14 | 0.14 |
| White base from Ex. 1 | Add to 100% | Add to 100% | Add to 100% | Add to 100% | Add to 100% | Add to 100% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water soluble pouch comprising a first compartment comprising a first composition and a second compartment comprising a second composition superposed above said first compartment, wherein said first compartment comprises a first liquid composition comprising an organic opacifier and an antioxidant and has a fresh Hunter L value of greater than about 70 and b value of less than about 4 and said second compartment comprising a coloring agent and does not comprise opacifier and further wherein said first composition and said second composition are visibly distinct from one another, further wherein the antioxidant is selected from the group consisting of alkali metal sulfites, alkali earth metal sulfites, hydrosulfites, and mixtures thereof, further wherein the opacifier comprises styrene/acrylic acid copolymers, further wherein the opacifier is present at a level of from 1% to 2.2%, by weight of the first composition, and further wherein the first composition is free of pearlescent agent.

2. A pouch according to claim 1 wherein the first composition has a 10 day storage Hunter L value of greater than about 70.

3. A pouch according to claim 2 wherein the difference in color between a fresh first composition and a 10 day old first composition, ΔE after 10 days, is less than about 7.

4. A pouch according to claim 1, wherein the difference in color between compositions of the compartments when fresh, ΔE fresh compartments, is greater than about 35.

5. A water soluble pouch according to claim 1 wherein the first composition comprises from about 0.01% to about 2% by weight of antioxidant.

6. A water soluble pouch according to claim 1, wherein the opacifier is present at a level of from 1.4% to 1.8%, by weight of the first composition.

7. A water soluble pouch according to claim 1, wherein the antioxidant is selected from the group consisting of sodium sulfite, potassium sulfite, hydrosulfite, and mixtures thereof.

8. A water soluble pouch according to claim 1 wherein the first composition comprises perfume.

9. A water soluble pouch according to claim 8 wherein the perfume is encapsulated.

10. A water soluble pouch according to claim 9 where the perfume is encapsulated in a melamine/formaldehyde coating.

11. A water soluble pouch comprising a first compartment comprising a first composition and a second compartment comprising a second composition superposed above said first compartment, wherein said first compartment comprises a first liquid composition comprising an organic opacifier present at a level of from 1% to 2.2% by weight of the first composition and an antioxidant and has a fresh Hunter L value of greater than about 70 and b value of less than about 4 and said second compartment comprising a coloring agent and further wherein said first composition and said second composition are visibly distinct from one another, and further wherein the antioxidant is selected from the group consisting of alkali metal sulfites, alkali earth metal sulfites, hydrosulfites, and mixtures thereof, wherein the coloring agent of the second composition comprises a whitening agent, further wherein the opacifier comprises styrene/acrylic acid copolymers, and wherein the first composition is free of pearlescent agent.

12. A water soluble pouch according to claim 11, wherein the whitening agent is selected from the group consisting of triarylmethane blue basic dye; a triarylmethane violet basic dye; a methine blue basic dye; a methane violet basic dye; an anthraquinone blue basic dye; an antraquinone violet basic dye; an azo dye basic blue 16, basic blue 65, basic blue 66, basic blue 67, basic blue 71, basic blue 159, basic violet 19, basic violet 35, basic violet 38, or basic violet 48; oxazine dye basic blue 3, basic blue 75, basic blue 95, basic blue 122, basic blue 124, basic blue 141, or Nile blue A; a xanthene dye basic violet 10; an alkoxylated anthraquinone polymeric colorant; alkoxylated thiophene; triphenyl methane; antraquinones; and mixtures thereof.

13. A water soluble pouch according to claim 11, wherein the whitening agent is characterized by the following structure:

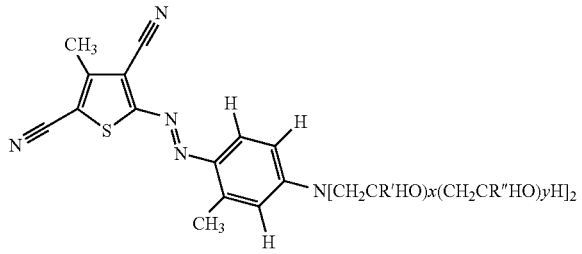

wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein $x+y\leq 5$; wherein $y\geq 1$; and wherein z=0 to 5.

14. A water soluble pouch comprising a first compartment comprising a first composition and a second compartment comprising a second composition superposed above said first compartment, wherein said first compartment comprises a first liquid composition comprising an organic opacifier present at a level of from 1% to 2.2% by weight of the first composition and an antioxidant and has a fresh Hunter L value of greater than about 70 and b value of less than about 4 and said second compartment comprising a coloring agent and does not comprise opacifier and further wherein said first composition and said second composition are visibly distinct from one another, and further wherein the antioxidant is selected from the group consisting of alkali metal sulfites, alkali earth metal sulfites, hydrosulfites, and mixtures thereof, further wherein the first composition comprises a nonionic surfactant selected from condensation products of C12-C15 alcohols with from about 5 to about 20 moles of ethylene oxide per mole of alcohol, further wherein the opacifier comprises styrene/acrylic acid copolymers, and wherein the first composition is free of pearlescent agent.

15. A water soluble pouch according to claim 14 wherein the first composition comprises perfume.

16. A water soluble pouch according to claim 15 wherein the perfume is encapsulated in a melamine/formaldehyde coating.

* * * * *